US006939238B2

(12) United States Patent
Brayton

(10) Patent No.: US 6,939,238 B2
(45) Date of Patent: Sep. 6, 2005

(54) GOLF PUTTING TRAINING DEVICE

(76) Inventor: Terry Brayton, 70 E. Cross Island Rd., Camano Island, WA (US) 98282

( * ) Notice: Subject to any disclaimer, the term of this patent is extended or adjusted under 35 U.S.C. 154(b) by 0 days.

(21) Appl. No.: 10/686,334

(22) Filed: Oct. 14, 2003

(65) Prior Publication Data

US 2005/0079921 A1 Apr. 14, 2005

(51) Int. Cl.[7] ..... A63B 69/36
(52) U.S. Cl. ..... 473/162; 473/158
(58) Field of Search ..... 473/157–164, 473/181

(56) References Cited

U.S. PATENT DOCUMENTS 1,582,183 A * 4/1926 Maurer ..... 473/160
1,761,039 A * 6/1930 Hazeltine ..... 473/160
1,939,819 A * 12/1933 Lopez ..... 273/125 R
2,827,299 A * 3/1958 Dean ..... 473/158
3,342,495 A * 9/1967 Wasley ..... 473/164
3,591,176 A 7/1971 Roth
3,685,833 A * 8/1972 Jack, Jr. ..... 473/151
3,727,917 A * 4/1973 MacLean ..... 473/160
3,801,107 A * 4/1974 Martin ..... 473/162
3,861,524 A * 1/1975 Coleman ..... 206/315.1
4,114,889 A * 9/1978 Midana ..... 473/159
4,124,210 A * 11/1978 Mason ..... 473/157
4,247,112 A * 1/1981 Del Raso ..... 473/153
4,886,274 A * 12/1989 Park ..... 473/164
4,953,865 A * 9/1990 Coombs et al. ..... 473/158
4,957,288 A * 9/1990 Kantner et al. ..... 473/3
5,002,280 A 3/1991 Hines
5,171,016 A * 12/1992 Kamal ..... 473/160
5,318,303 A 6/1994 Kim
5,429,368 A * 7/1995 Adams ..... 473/162
5,692,963 A * 12/1997 Holcombe ..... 473/162
2003/0148813 A1 8/2003 Barlow

* cited by examiner

*Primary Examiner*—Mark S. Graham
(74) *Attorney, Agent, or Firm*—Wells St. John P.S.

(57) ABSTRACT

A golf putting training device is described and which includes an elongated frame having opposite ends and sides, and defining a channel therebetween the opposite ends and sides; and a bridge extending between the opposite sides and located intermediate the opposite ends of the frame, and wherein the bridge defines, in part, an aperture through which a golf ball may pass.

2 Claims, 4 Drawing Sheets

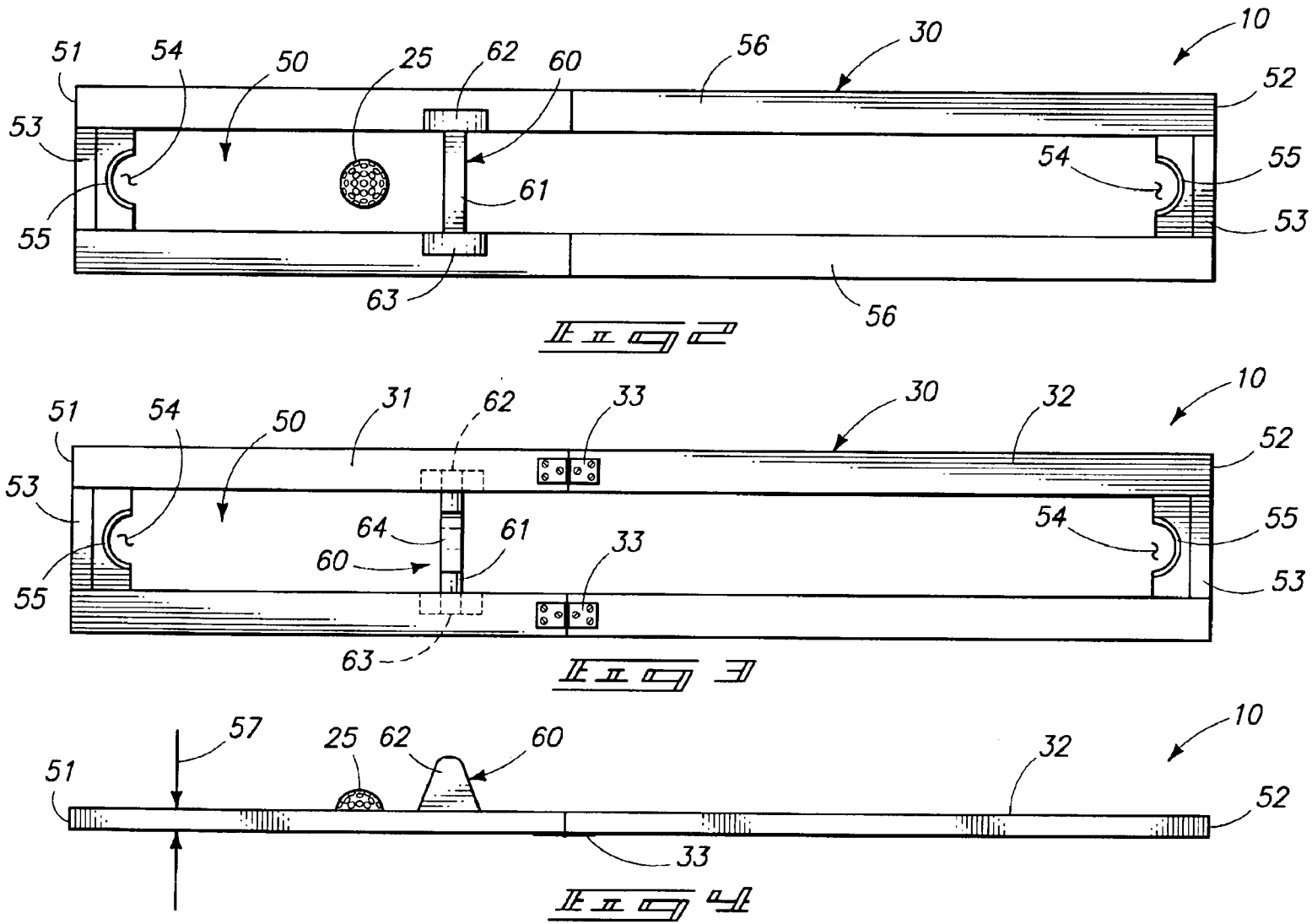
Fig II
Fig II
Fig II

GOLF PUTTING TRAINING DEVICE

TECHNICAL FIELD

The present invention relates to a golf putting training device and more specifically to a golf putting training device having an elongated frame and which incorporates a bridge defining an aperture through which a golf ball may pass in order to assist a golfer in increasing the accuracy of a putt.

BACKGROUND OF THE INVENTION

It has been reported by many golf experts that a golfer will typically use his putter more than any other club in his golf bag when playing a round of golf. Many skilled golfers report that they may employ their putter from anywhere between 30 and 40 percent of their golf strokes in any given games. Most golfers have long recognized that to improve their overall game, a focused concentration on their putting skills is very important. For example, one of the common mistakes typically committed by many golfers is a failure to keep the face of the putter perpendicular to the line of travel of the putter throughout the entire stroke.

Since putting can be practiced on a smaller area than is required for practicing other golf shots, many practice putting units, and other assemblies have been developed. As a general matter, many of these units provide elevated "hole areas" so that the golf balls that are hit to the hole must first strike a raised area around the hole. This obviously creates an effect on the golf ball that is not encountered on a genuine putting green. Other problems associated with these practice units include the fact that the length of the putts utilized on same remain substantially constant. Of course, during the practice of the game, putts of various lengths are routinely encountered.

Yet still a further difficulty encountered with golf putting devices of this type is that many of them are rather large and cumbersome, take time to assemble, or otherwise cannot be conveniently stored when not in use.

The present invention addresses many of the perceived shortcomings of the prior art devices utilized heretofore.

SUMMARY OF THE INVENTION

A first aspect of the present invention relates to a golf putting training device which includes an elongated frame having opposite ends and sides and defining a channel therebetween the opposite ends and the sides; and a bridge extending between the opposite sides and located intermediate the opposite ends of the frame, and wherein the bridge defines, in part, an aperture through which a golf ball may pass.

Another aspect of the present invention relates to a golf putting training device which includes an elongated frame having opposite ends and defining a length dimension which represents a putting distance to an imaginary cup, and opposite sides which define a width dimension which is operable to receive a golf club head therebetween; and a bridge mounted on the elongated frame and extending between the opposite sides, and wherein the bridge is mounted intermediate the opposite ends of the frame and which defines, in part, an aperture through which a properly aligned golf ball putted by the golf club head may pass to traverse the putting distance to the imaginary cup.

Yet still a further aspect of the present invention relates to a golf putting training device which includes an elongated frame having opposite ends and defining a channel which has a length and a width dimension and which is operable to receive the club head of a golf putter which has a heel and a toe, and wherein the width dimension of the channel is greater than the length dimension of the club head when measured between the heel and toe thereof; and a bridge mounted on the elongated frame and located intermediate the opposite ends, and wherein the bridge defines in part an aperture through which a golf ball having a radius may pass when the golf ball is placed in the channel and struck by the club head of the golf putter, and wherein the aperture provides an aiming point for the golfer to facilitate the proper alignment of a putt, and wherein the passage of the golf ball through the aperture demonstrates a proper alignment of a putt, and wherein the elongated frame has a height dimension greater than the radius of the golf ball.

These and other aspects of the present invention will be discussed in greater detail hereinafter.

BRIEF DESCRIPTION OF THE DRAWINGS

The accompanying drawings serve to explain the principals of the present invention.

FIG. 2 is a top plan view of the golf putting training device as shown in FIG. 1.

FIG. 3 is a bottom plan view of the golf putting training device as shown in FIG. 1.

FIG. 4 is a side elevation view of the golf putting training device as shown in FIG. 1.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figures 1, 1A:
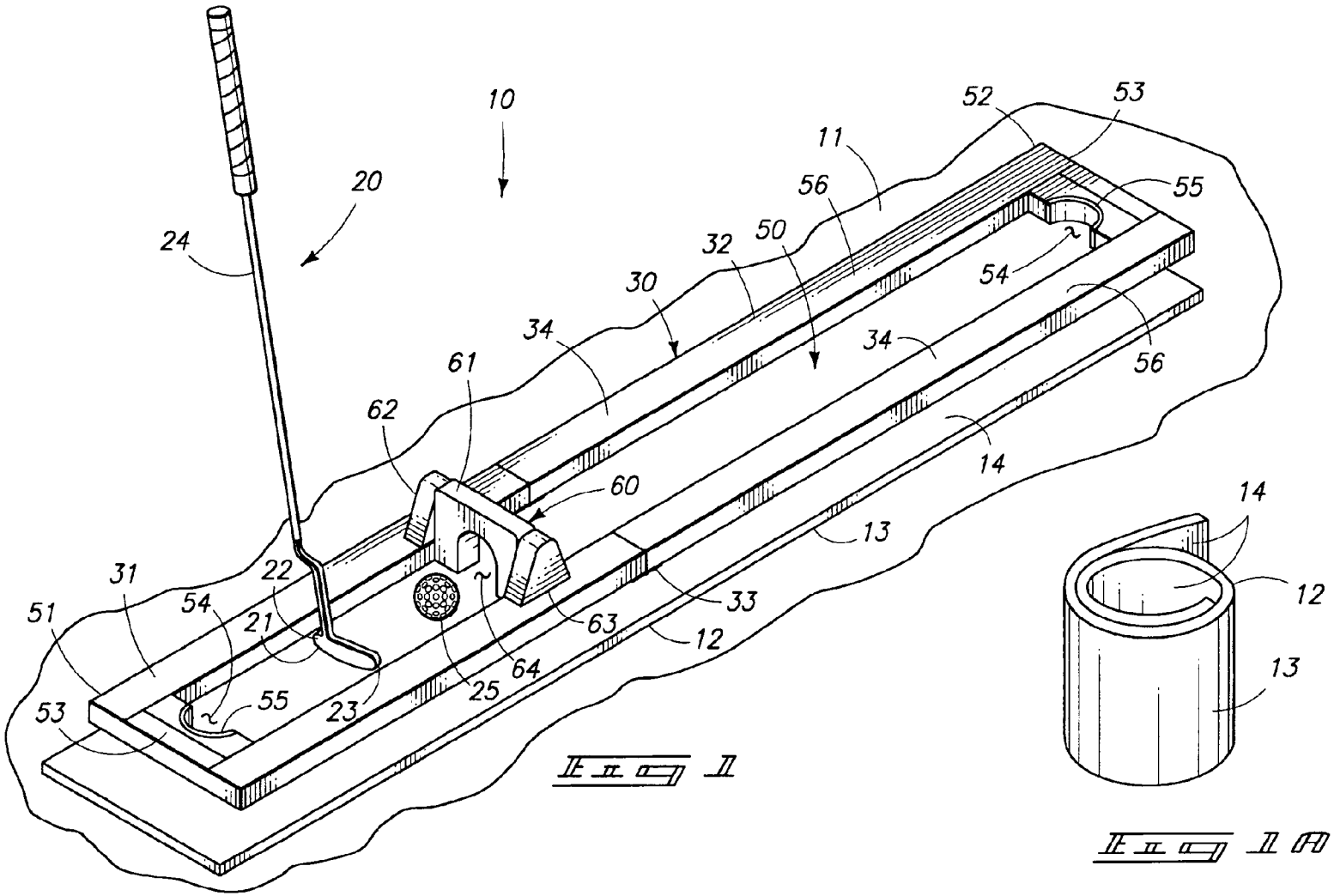
FIG. 1 is a perspective view of the present invention shown in use with a golf putter and an associated golf ball.
FIG. 1A is a perspective view of a synthetic playing surface upon which the device rests and which is shown in a stored configuration.

The golf putting training device of the present invention is generally indicated by the numeral 10 in FIG. 1 and following. Referring now to FIG. 1, the golf putting training device 10 of the present invention is shown as it would be utilized in a typical operable configuration on a floor or other supporting surface 11. As will be seen, the golf putting training device is used in combination with a synthetic, simulated turf or other putting surface 12, which is laid on or otherwise supported upon the floor or supporting surface 11. The simulated turf has a bottom surface 13 which rests on the floor or supporting surface 11, and an upper top surface 14, which provides a surface texture which closely simulates typical putting green conditions. As seen most clearly by reference to FIG. 1A, the synthetic simulated turf or putting surface 12 may be conveniently rolled up for storage when the golf putting training device 10 is not in use. As seen in FIG. 1, the simulated turf 12 has a length and width dimension which is just slightly greater than the length and width dimension of the golf putting training device 10 as will be described below.

The golf putting training device 10 of the present invention is utilized in combination with a golf putter as shown in FIG. 1. The golf putter 20 includes a golf club head 21 which has a heel portion 22 and a toe 23. The length dimension of the golf club head 21 is measured between the heel 22 and the toe 23. The shaft 24 of the golf putter 20 is grasped by the hands of the golfer (not shown) and is utilized to swing the golf club head 21 to contact the golf ball 25. As seen in FIG. 1 and following, the golf ball 25 has diametral and radial dimensions which will be discussed in greater detail hereinafter.

Figure 7:
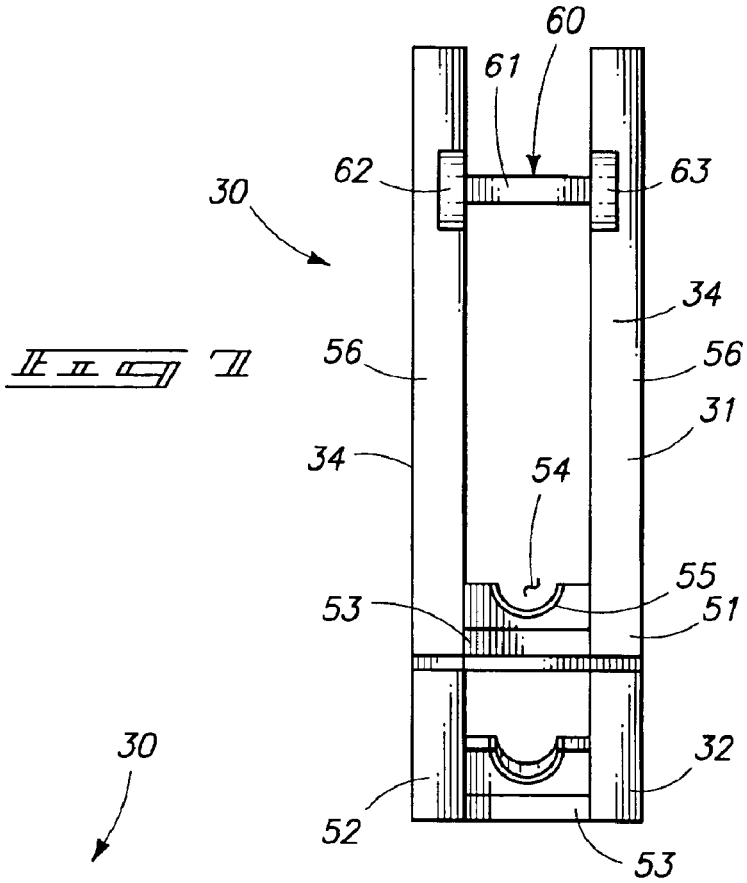
FIG. 7 is a partial plan view showing the golf putting training device of FIG. 1 shown in an inoperable, partially folded position.
Figure 8:
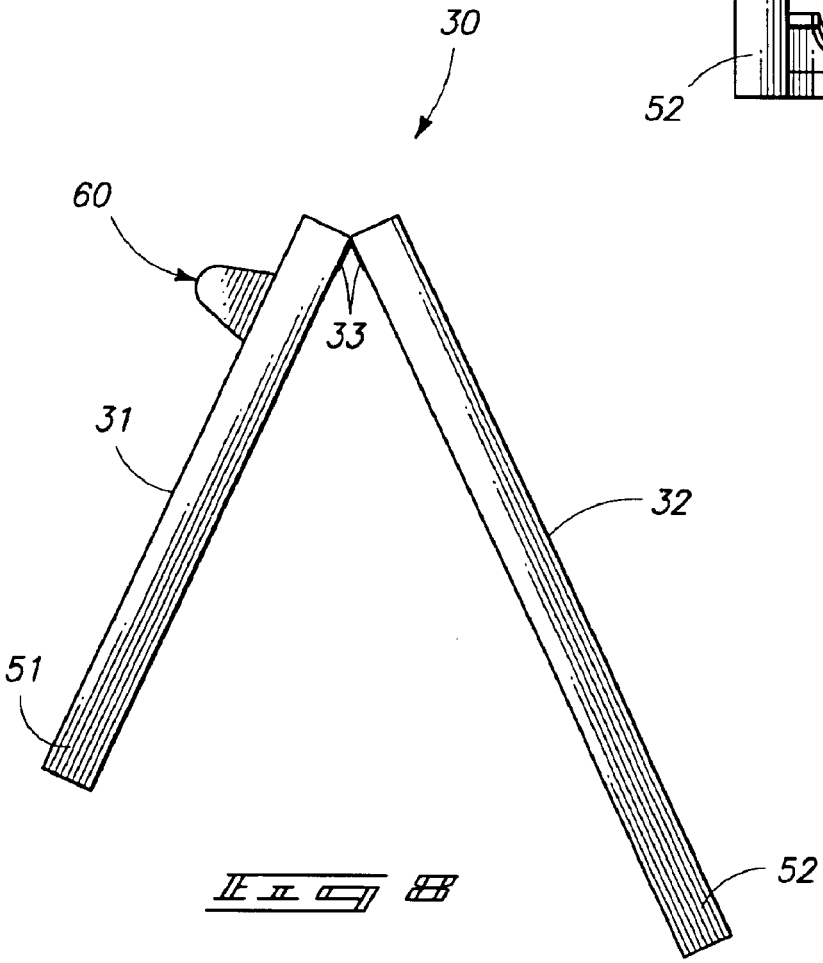
FIG. 8 is a side elevation view of the golf putting training device of FIG. 1 shown in an inoperable, partially folded position.

The golf putting training device 10 of the present invention includes an elongated frame which is generally indicated by the numeral 30. The elongated frame may be fabricated from a number of materials including wood, metal, plastic or combinations of the foregoing. The elongated frame is fabricated so that it is rigid, yet lightweight so that it may be easily transported, for example, when a golfer is traveling. The elongated frame has a first portion 31, and a second portion 32. The first and second portion 31 and 32 may be releasably coupled together to form the elongated frame. Still further, the first and second portions may be rendered operable to be readily uncoupled from each other to facilitate the storage of the golf putting training device 10 when the device is not in use. As seen in FIG. 1 and following, the first and second portions 31 and 32, are hingedly mounted together by way of a hinge 33, and which permits the golf putting training device 10 to be folded for storage. Such can be seen by reference to FIGS. 7 and 8. As best understood by a study of FIG. 2, the first and second portions each have a length dimension which, as illustrated in the drawings, is substantially unequal. However, it will be appreciated from a study of FIG. 6 that in one form of the invention, the length dimensions of the respective portions can be rendered substantially equal. With respect to FIG. 6, it will be seen, in a second form of the invention and which is generally indicated by the numeral 40, that the elongated frame 30, has first and second portions 31 and 32. In this form of the invention, one of the first or second portions (here shown as the first portion 31) defines an internal cavity 41. In this arrangement, one of the first or second portions 31 or 32 (here shown as 32) telescopes within the internal cavity 41 to facilitate storage of the golf putting training device 10. When rendered operable, the portion which has been telescoped is pulled outwardly to a given distance desired by the golfer (not shown). The portion which is withdrawn moves along a path of travel which generally indicated by the numeral 42.

As seen in FIG. 1 and following, the elongated frame 30 defines a channel 50 which has a width dimension, as measured between the opposite sides of the elongated frame. The golf putter 20, and more specifically the club head 21, has a length dimension as measured between the heel and the toe such that the width dimension of the channel 50 is greater than the length dimension of the club head such that it may be received in the channel and located between the opposite sides of the elongated frame. As seen in FIG. 1, the opposite sides of the frame 30 are located near and in closely spaced relation relative to the club head 21 when it is appropriately oriented in the channel 50 and in perpendicular relation relative to the opposite sides of the frame 30. Such is illustrated in FIG. 1. The elongated frame 30 as illustrated in FIG. 1, and following, includes opposite first and second ends 51 and 52, respectively. The opposite first and second ends include an end portion 53 which defines a semicircular cavity 54 having a dimension which simulates, in part, the dimension of a cup for receiving a golf ball 25 which will be putted by the golf putter 20. A shock absorbing surface 55 is affixed to the wall defining the semicircular cavity 54 in order to prevent a golf ball that has been putted by the golf putter 20 from leaving the channel 50. As will be seen therefore, the elongated frame 30 having the opposite first and second ends 51 and 52 defines a length dimension which represents a putting distance to an imaginary cup as defined by the semicircular cavity 54, and further defines a width dimension as measured between the opposite sides 56 and which is operable to receive a golf club head 21 therebetween. As constructed, the elongated frame 30, which comprises the first portion 31, and the second portion 32 and which are releaseably coupled together has a height dimension as indicated by the line labeled 57 (FIG. 4), and wherein the height dimension of the elongated frame 30 is greater than the radial dimension, and less than the diametral dimension of the golf ball 25.

Figure 5:
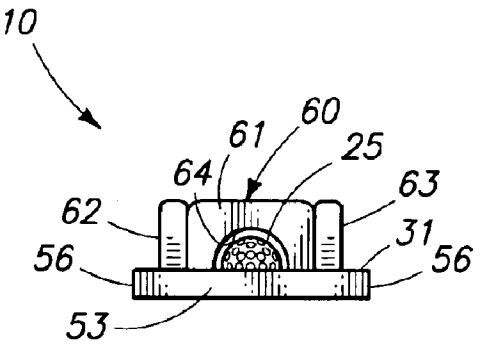
FIG. 5 is an end view of the golf putting training device as shown in FIG. 1.
Figure 6:
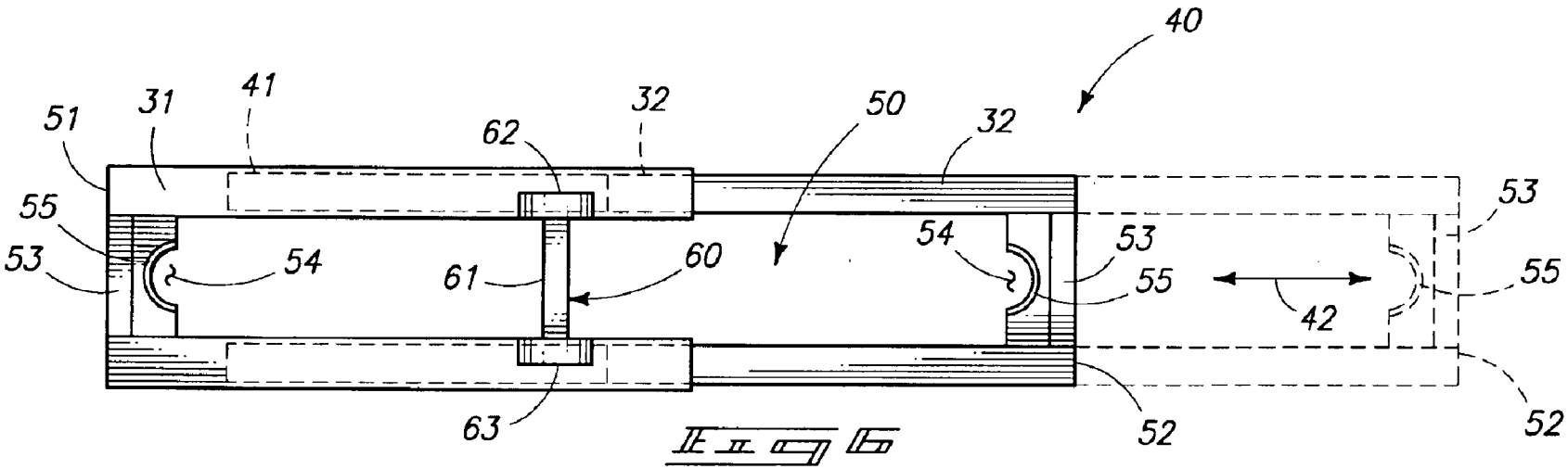
FIG. 6 is a top, plan view of a second form of the golf putting training device of the present invention with some underlying surfaces shown in phantom lines.

Referring now to FIG. 1, and following, the golf putting training device 10 of the present invention includes a bridge which is generally indicated by the numeral 60, and which extends between the opposite sides 56 of one of the portions 31 or 32. The bridge 60 is mounted intermediate the opposite first and second ends 51 and 52 of the elongated frame 30. As illustrated, the bridge 60 is mounted on the first portion 31 of the elongated frame. In the present invention, the bridge may be located at a position which is approximately midway between the opposite ends of the elongated frame as seen in FIG. 6 or further more closely adjacent to one of the ends 51 or 52 then the other. The location of the elongated bridge 60, as seen in FIG. 1 for example, provides a convenient division of the channel 50 which will permit a golfer to practice putts having different distances. The bridge 60 includes a main body 61 having a first end 62 mounted on one side 56 of the elongated frame, and an opposite second end 63 mounted on the opposite side thereof. The main body 61 defines an aperture 64 (FIGS. 1 and 5) through which a properly aligned golf ball 25 putted by the golf club head 21 may pass to traverse the putting distance selected to the imaginary cup as defined by the semicircular cavity 54. As illustrated most clearly by reference to FIG. 5, the aperture 64 has dimensions which are just slightly greater than the diametral dimensions of the golf ball 25. As seen most clearly by reference to FIG. 1, the aperture provides an aiming point for the golfer to facilitate the proper alignment of a putt. When the putt is properly aligned, the passage of the golf ball 25 through the aperture 64 demonstrates the proper alignment of the putt. If the putt is properly aligned, the golf ball 25 will pass through the aperture 64 and travel directly to the imaginary cup as defined by the semicircular portion 54. On the other hand, if the putt is not properly aligned, the golf ball 25 will not pass through the aperture 64 and will strike the main body 61 of the bridge, bouncing backwards towards the golf putter 20. As seen in the drawing, the simulated turf or synthetic or flexible surface 12 upon which the golf ball 25 travels, cooperates with the frame to provide a substantially continuous surface to aid in the motion of the golf ball 25 towards the imaginary cup.

Operation

The operation of the described embodiments of the present invention is believed to be readily apparent and is briefly summarized at this point.

A golf putting training device 10 of the present invention includes in its broadest aspect an elongated frame 30 having opposite ends 51 and 52 and sides 54. The elongated frame 30 defines a channel 50 which extends therebetween the opposite ends 51 and 52 and sides 56. Still further, the golf putting training device 10 includes a bridge 60 extending between the opposite sides 56 and which is located intermediate the opposite ends 51 and 52 of the frame. The bridge 60 defines, in part, an aperture 64 through which a golf ball 25 may pass.

Still further, a golf putting training device 10 of the present invention includes an elongated frame 30 having opposite ends 51 and 52 and defining a length dimension which represents a putting distance to an imaginary cup, as defined by a semicircular portion 54. The opposite sides 56 of the elongated frame 30 define a width dimension which is operable to receive a golf club head 21 therebetween. As seen in FIG. 1, and following, a bridge 60 is mounted on the elongated frame 30 and extends between the opposite sides 56. The bridge 60 is mounted intermediate the opposite ends 51 and 52 of the elongated frame 30. The bridge 60 defines, in part, an aperture 64 through which a properly aligned golf ball 25 putted by the golf club head 21 may pass to traverse the putting distance to the imaginary cup as defined by the semicircular cavity 54.

More specifically, the golf putting training device 10 of the present invention includes an elongated frame 30 having opposite ends 51 and 52 and defining a channel 50 which has a length and a width dimension. The elongated frame is operable to receive the golf club head 21 of a golf putter 20 which has a heel 22 and a toe 23. The width dimension of the channel 50 is greater than the length dimension of the club head 21 when measured between the heel and toe thereof. A bridge 60 is provided and mounted on the elongated frame 30. The bridge 50 is located intermediate the opposite first and second ends 51 and 52. The bridge 60 defines, in part, an aperture 64 through which a golf ball 25 having a radius may pass when the golf ball is placed in the channel 50 and struck by the club head 21 of the golf putter 20. The aperture 64 provides an aiming point for the golfer to facilitate the proper alignment of a putt. The passage of the golf ball 25 through the aperture 64 demonstrates a proper alignment of a putt. As earlier discussed, the elongated frame 30 has a height dimension 57 greater than the radial dimension of the golf ball 25. This dimensional relationship substantially inhibits the golf ball 25 from jumping or otherwise moving outside of the channel 50 when struck by the golf club 20.

Therefore the present golf putting training device 10 of the present invention provides a convenient means whereby a golfer may practice putts of various lengths and further provides immediate feedback so that the golfer may correct putting errors being made. As earlier discussed, a failure of the golf ball 25 to pass through the aperture 64, as defined by the bridge 60, demonstrates that a golf putt is improperly aligned to reach the imaginary cup as defined by the semicircular cavity 54 which is formed in the end portions 53. Still further, the present device 10 allows the golfer to practice putts of various lengths in view of the location of the bridge as illustrated in FIG. 1 and following.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A golf putting training device comprising:

an elongated frame having opposite sides, and ends and defining a channel which has a length and a width dimension and which is operable to receive the club head of a golf putter which has a heel and a toe, and wherein the width dimension of the channel is greater than the length dimension of the club head when measured between the heel and toe thereof, and wherein the opposite sides of the elongated frame are positioned in closely spaced relation relative to the heel and toe of the golf club head when the golf club head is oriented substantially perpendicular to the opposite sides of the elongated frame, and wherein each of the opposite ends of the elongated frame defines, in part, a semicircular portion which simulates an imaginary cup; and a bridge fixedly mounted on the elongated frame and located intermediate the opposite ends, and wherein the bridge defines in part an aperture through which a golf ball having a radius may pass when the golf ball is placed in the channel and struck by the club head of the golf putter, and wherein the aperture provides an aiming point for the golfer to facilitate the proper alignment of a putt, and wherein the passage of the golf ball through the aperture demonstrates a proper alignment of a putt, and wherein the elongated frame has a height dimension greater than the radius of the golf ball, and wherein the golf ball may be putted in opposite directions through the aperture and towards the opposite ends of the elongated frame to simulate putts of various lengths.

2. A golf putting training device, comprising:

an elongated rectangular frame having opposite ends, and sides and defining a channel therebetween, and wherein a semicircular cavity is defined by each of the opposite end portions, and which simulates, in part, a cup for receiving a golf ball which is putted by a golf putter which has a club head defined by a face and which has a length dimension, and wherein the channel has a width dimension which receives the golf club head, and wherein the opposite sides of the elongated frame are disposed in closely spaced relation relative to the golf club head when the golf club head is appropriately oriented in the channel; and a bridge extending between the opposite sides of the elongated narrowly rectangular frame, and wherein the bridge defines, in part, an aperture through which the golf ball may pass, and wherein the golf putter may alternatively putt the golf ball at the simulated cups which are individually located at the opposite ends of the narrowly rectangular frame, and in opposite directions through the aperture defined by the bridge.

* * * * *